US006144753A

United States Patent [19]

Ohyaba et al.

[11] Patent Number: 6,144,753

[45] Date of Patent: Nov. 7, 2000

[54] DAMPER FOR A SPEAKER APPARATUS

[75] Inventors: Takashi Ohyaba; Shunichi Takahashi; Showichiro Terauchi; Takanobu Saito; Tatsuya Ando; Yoshiya Usami; Hiroyuki Kataoka, all of Saitama-ken, Japan

[73] Assignee: Pioneer Electronic Corporation, Tokyo, Japan

[21] Appl. No.: 08/848,716

[22] Filed: May 19, 1997

[30] Foreign Application Priority Data

May 23, 1996 [JP] Japan ..... 8-151610

[51] Int. Cl.[7] ..... H04R 25/00

[52] U.S. Cl. ..... 381/405; 381/400; 381/404; 29/594; 29/264; 29/609.1; 181/166; 181/171; 181/172

[58] Field of Search ..... 381/403, 404, 381/405, FOR 157; 29/594, 264, 609.1; 181/166, 171, 172

[56] References Cited

U.S. PATENT DOCUMENTS

| | | | |
|---|---|---|---|
| 2,812,825 | 11/1957 | Matthews | 381/403 |
| 3,862,376 | 1/1975 | White | 179/115 R |
| 4,891,399 | 1/1990 | Ohkawa et al. | 523/200 |
| 5,451,624 | 9/1995 | Memon et al. | 524/151 |
| 5,790,682 | 8/1998 | Hachiya et al. | 381/197 |
| 5,850,462 | 12/1998 | Sakamoto et al. | 381/405 |

OTHER PUBLICATIONS

Abstract of Japanese Patent Publication No. 63 164800A, by Matsushita, dated Jul. 8, 1988.

Abstract of Japanese Patent Publication No. 56 092014A, by Toshiba, dated Jul. 25, 1981

International Application Publication No. WO 82/03594, by Itera Components AB, dated Oct. 28, 1982.

Abstract of Japanese Patent Publication No. 03 263457A, by Polyplastics Co., dated Nov. 22, 1991.

Abstract of Japanese Patent Publication No. 07 292227A, by Mitsubishi Rayon, dated Nov. 7, 1995.

European Patent Publication No. 0 457 918A, by Polyplastics Co., dated Nov. 27, 1991.

*Primary Examiner*—Curtis A. Kuntz
*Assistant Examiner*—Dionne N. Harvey
*Attorney, Agent, or Firm*—Arent Fox Kintner Plotkin & Kahn PLLC

[57] ABSTRACT

A speaker apparatus has a damper for supporting vibrating elements including a vibrating diaphragm. The damper is formed by injecting a predetermined amount of a resin material into a metal mold of an injection molding equipment.

11 Claims, 4 Drawing Sheets

DAMPER FOR A SPEAKER APPARATUS

FIELD OF THE INVENTION

The present invention relates to a speaker apparatus, in particular to a speaker apparatus for use in an audio system or a video system.

BACKGROUND OF THE INVENTION

FIG. 6 is a cross sectional view showing a conventional speaker apparatus. As shown in FIG. 6, the conventional io speaker apparatus includes a ring-shaped magnet 8, a ring-shaped magnetic pole plate 7, a pore yoke 4 having a center pore 4'. With an effect of the ring-shaped magnet 8, a magnetic gap containing a magnetic field is formed between the outer wall of center pore 4' and the inner wall of the ring-shaped magnetic pole plate 7. Disposed in the magnetic gap is a voice coil 6 wound around a bobbin 2. When electric current is flowing through the voice coil 6, the bobbin 2 will be driven (in a vertical direction in the drawing) due to an action of electromagnetic effect in accordance with Fleming's left-hand rule. Thus, a vibrating diaphragm 1 which is attached on a frame 10 through an annular edge 9 and a damper 3, will be vibrated so as to produce a sound corresponding to the current flowing through the voice coil 6. Further, a protection cap 11 is provided on the center of the diaphragm 1 to prevent outside dust from invading into the magnetic pole plate 7.

Referring again to FIG. 6, the damper 3 is a corrugation damper formed by impregnating a woven fabric with a thermosetting resin and then heat-pressing the resin-impregnated woven fabric, or a butterfly-shaped damper formed by properly punching a piece of phenol resin sheet or a metal sheet.

However, a corrugation damper has a problem of aeolotropy. Namely, with a corrugation damper, the magnitude of a holding force will be different from one direction to another. In particular, when there is a large vibration, a voice coil held by the corrugation damper will cause an undesired rolling movement, undesirably contacting with other elements in the speaker apparatus. As a result, it will be difficult to correctly produce a reproduced sound.

On the other hand, although a butterfly-shaped damper made of a phenol resin or metal sheet does not have a problem of aeolotropy, because a butterfly-shaped damper is formed by punching a piece of phenol resin sheet or a metal sheet, there is a wast of useful material (phenol resin or metal sheet), hence the production cost is high.

Recently, it has been required that a loudspeaker should be small in size but capable of reproducing a louder and low voice. In order to obtain a louder and low voice in a small size loudspeaker, it is necessary that the vibration amplitude of a vibrating diaphragm be large. However, with a damper made of a phenol resin or metal sheet, when there is a large vibration amplitude, such a damper is prone to be damaged because there is not a sufficient bending strength or because there is a repeated fatigue. Moreover, since a damper is usually positioned adjacent the voice coil which generates heat, it is also required that a heat resistant material be used to make a damper.

In addition, a damper such as indicated by the reference numeral 3 has a center hole through which a voice coil 6 wound around a bobbin 2 may pass. When assembling a loudspeaker apparatus, after a voice coil 6 has been passed through the center hole, the bobbin 2 is bonded to the damper 3 along the inner circumferential portion thereof. If, in order for the voice coil 6 to easily pass through the center hole, the center hole of the damper 3 is required to have a large diameter, resulting in a problem that an adhesive agent for bonding the bobbin 2 to the damper 3 will flow through an undesirably formed annular gap between the bobbin 2 and the inner wall of center hole, hence making it difficult to form an exact bonding between the bobbin 2 and the damper 3, and thus rendering it difficult for the bobbin 2 to be located at a desired correct position with respect to the damper 3.

On the other hand, if an annular gap between the bobbin 2 and the damper 3 is to be made as small as possible in order to achieve an exact bonding therebetween, it will be difficult for the voice coil 6 to pass through the center hole of the damper 3, or otherwise requiring an extremely high precision when making the damper 3.

SUMMARY OF THE INVENTION

It is an object of the present invention to provide an improved speaker apparatus equipped with an damper having a high durability and good manufacturability, so as to solve the above-mentioned problems peculiar to the above-mentioned prior arts.

According to the present invention, there is provided a speaker apparatus having a damper for supporting vibrating elements including a vibrating diaphragm, characterized in that said damper is formed by injecting a predetermined amount of a resin material into a metal mold of an injection molding equipment.

In detail, said damper is formed by injecting a predetermined amount of a resin material into the metal mold through a plurality of injection inlets formed thereon. In fact, the plurality of injection inlets are symmetrically formed on the metal mold with respect to the centre axis of the damper.

In more detail, some of the injection inlets are formed on an inner circumferential portion of the metal mold, and other injection inlets are formed on an outer circumferential portion of the metal mold.

In one aspect of the present invention, the resin material for making the damper contains a PBT (polybutylene terephthalate) as its main component.

In another aspect of the present invention, the resin material for making the damper contains a polyoxymethylene as its main component.

In a further aspect of the present invention, the resin material for making the damper contains a reinforcing fiber as its additive.

In a still further aspect of the present invention, the resin material for making the damper contains an elastomer as its additive.

Moreover, as an alternative embodiment of the present invention, the damper has an inner circumferential portion provided with an annular hinge portion.

The above objects and features of the present invention will become more understood from the following description with reference to the accompanying drawings.

DETAILED DESCRIPTION OF THE PREFERRED EMBODIMENTS

Figure 1:
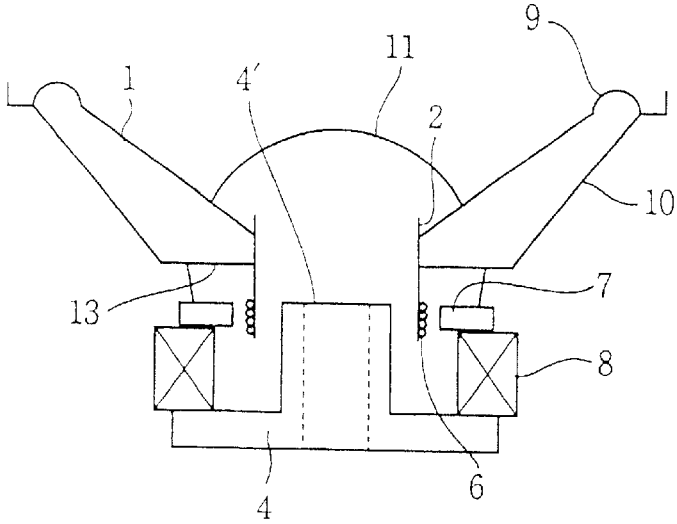
FIG. 1 is a cross sectional view showing a speaker apparatus according to the present invention.

The speaker apparatus according to the present invention will be described in detail below with reference to FIGS. 1–4, and FIG. 5*a*. However, in the following description, the same elements as those in the above prior art will be indicated by the same reference numerals.

Referring to FIG. 1, similar to the speaker apparatus of the above prior art, the speaker apparatus of the present invention, includes a ring-shaped magnet 8, a ring-shaped magnetic pole plate 7, a pore yoke 4 having a center pore 4'. With an effect of the ring-shaped magnet 8, a magnetic gap containing a magnetic field is formed between the outer wall of the center pore 4' and the inner wall of the ring-shaped magnetic pole plate 7. Disposed in the magnetic gap is a voice coil 6 wound around a bobbin 2.

Referring again to FIG. 1, when electric current is flowing through the voice coil 6, the bobbin 2 will be driven (in a vertical direction in the drawing) due to an action of electromagnetic effect in accordance with Fleming's left-hand rule. Thus, a vibrating diaphragm 1 which is attached on a frame 10 through an annular edge 9 and a damper 13, will be vibrated so as to produce a sound corresponding to the current flowing through the voice coil 6.

Similar to the above prior art, as shown in FIG. 1, a protection cap 11 is provided on the centre of the diaphragm 1 to prevent dust from invading into the magnetic pole plate 7.

Figure 2:
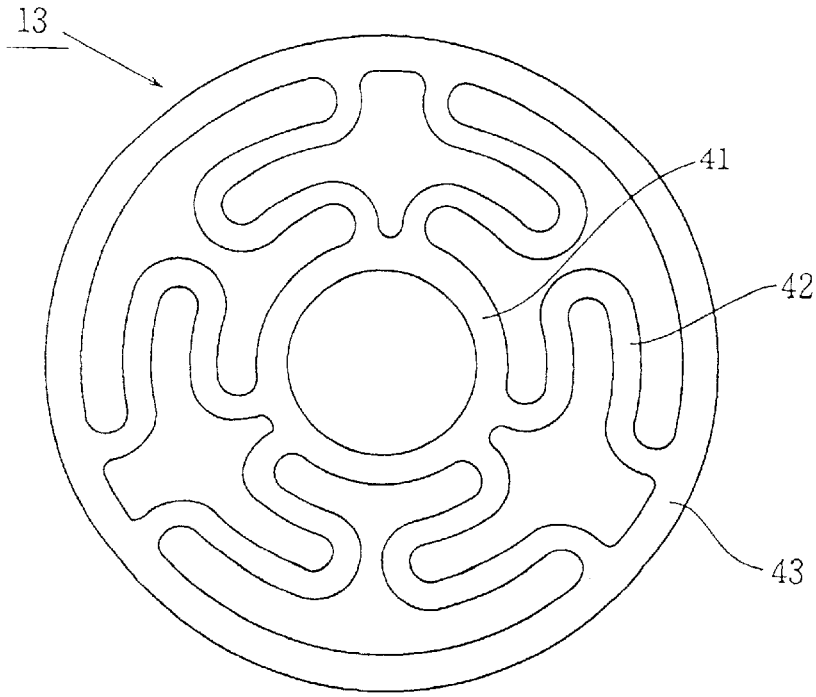
FIG. 2 is a plane view showing a damper used in the speaker apparatus of the present invention.

Referring to FIG. 2, the damper 13 is a solidified resin member formed by injecting a predetermined amount of a resin material (in liquid state) into a metal mold of an injecting mold equipment. As shown in FIG. 2, the damper 13 has an inner circumferential portion 41 and an outer circumferential portion 43, both of which are connected to each other through a connecting portion 42 such that a pair of portions 42 or gap therebetween form a butterfly shape. With the flexibility of the connecting portion 42, both the inner circumferential portion 41 and the outer circumferential portion 43 are movable in a direction perpendicular to the paper in the drawing.

Figure 3:
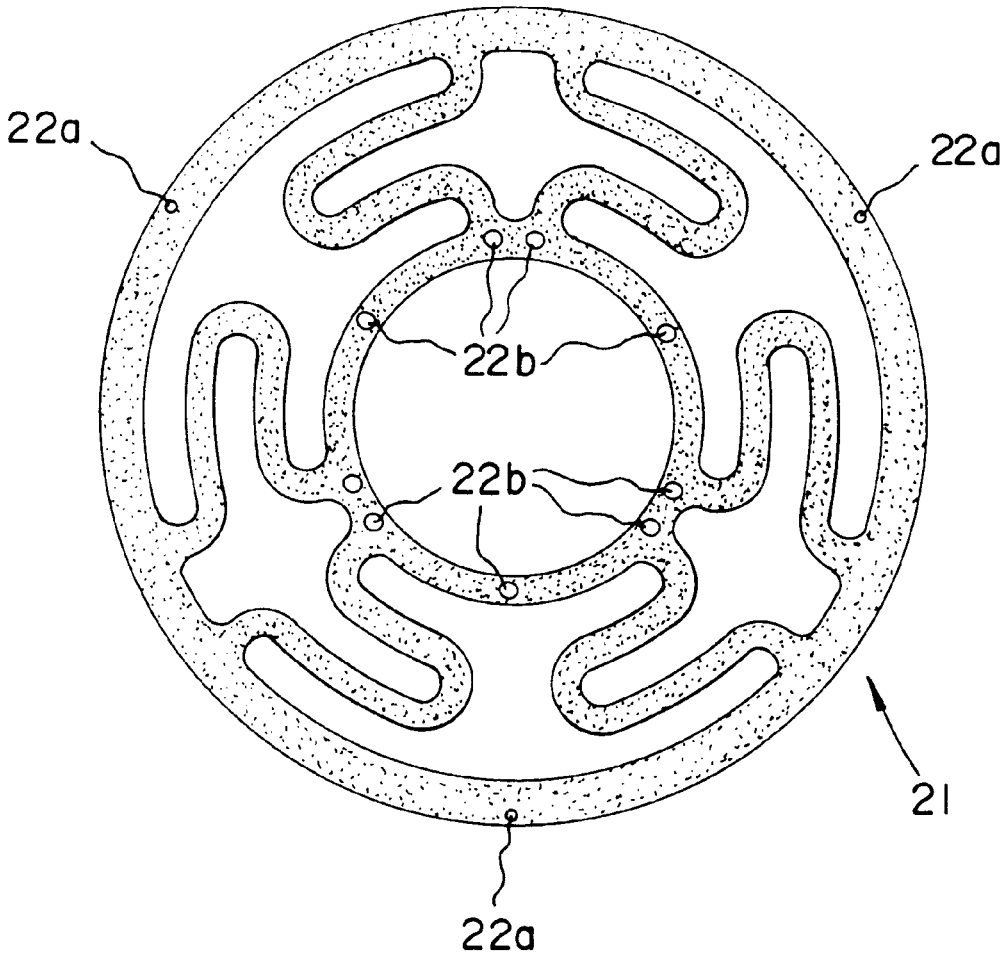
FIG. 3 is a plane view showing a metal mould for making the damper of FIG. 2.

In detail, the damper 13 is formed by injecting a predetermined amount of melt resin into a metal mold 21 shown in FIG. 3. If the damper 13 is formed by injecting the melt resin into the metal mold in an axis-symmetric manner, it is possible to obtain a damper without any problem called aeolotropy. In fact, if an amount of melt resin is injected into a metal mold through only one inlet, the chainlike giant molecules of the resin will be arranged in the mold in a direction in which resin flows. In this way, upon solidification, the injected resin will contract in a resin flowing direction to a greater extent than it does in a direction orthogonal to the resin flowing direction. As a result, with a damper thus formed, the properties in the resin flowing direction will be different from those in a direction orthogonal to the resin flowing direction.

In view of the above principle, we have found that if a plurality of resin injection inlets are uniformly and symmetrically (with respect to its center axis) formed on the metal mold as shown in FIG. 3, and if a predetermined amount of melt resin is injected into the metal mold through these injection inlets, there will not be any problem called aeolotropy occurring in a damper as a final product. Namely, properties at different positions of such a damper will be all the same to one another, so long as they are symmetrically located on the damper with respect to the center axis of the damper to the same extent.

For instance, it is possible to uniformly form a plurality of resin injection inlets on both an inner circumferential portion and an outer circumferential portion of a metal mold 21, as shown in FIG. 3. With the use of this arrangement, an amount of melt resin may be injected at the same time into the metal mold 21 through the plurality of resin injection inlets.

As an example shown in FIG. 3, three resin injection inlets 22*a* are formed on the outer circumferential portion of the metal mold 21, nine resin injection inlets 22*b* are formed on the inner circumferential portion of the metal mold 21.

Since a damper is usually made to be a piece of a relatively thin member, the space in vertical direction within the metal mold 21 is quite narrow. Consequently, if there is only one resin injection inlet on the metal mold, the resin will flow in such a narrow space with a great difficulty. However, in the present invention, since three resin injection inlets 22*a* are formed on the outer circumferential portion of the metal mold 21, and nine resin injection inlets 22*b* are formed on the inner circumferential portion of the metal mold 21, the liquid resin injected through the inlets 22*a* and 22*b* into the metal mold 21 will flow throughout the entire metal mold 21, thereby forming a damper having a uniform density.

Referring again to FIG. 3, since there are more resin injection inlets on the inner circumferential portion than on the outer circumferential portion of the metal mold 21, the resin being injected into the inner circumferential portion of the metal mold 21 will quickly flow towards the outer circumferential portion if there is a high internal pressure existing within the resin being injected through the inlets 22*b*.

The resin material for making the damper 13 is PBT (polybutylene terephthalate) which is capable of offerring a required heat-resistance and a good folding endurance. in fact, the PBT has, as its target heat-resistance, a thermal deformation temperature of 150–160° C. (4.6 kg/cm$^2$: ASTM (American Society for Testing and Materials) D648). Further, the PBT has, as its target folding endurance, a surface bending strength of 250 kg/cm$^2$ with respect to $10^7$ times of repeated loading. According to a series of tests which have been conducted, it is known that PC (polycarbonate) will be broken during a ten-hour test, whilst the PBT will not be broken at all even during a continuous 500-hour test. In the above tests, a speaker unit having a diameter of 15 cm was put into a cabinet having a size of 81 cm. The speaker unit is described to need a rated power input of 50 W, but a wetted pink noise of 75 W was applied.

Similar to PBT resin material, POM (polyoxymethylene) is also a good material for making a damper 13. POM has a thermal deformation temperature of 140–170° C. (4.6 kg/cm$^2$: ASTM D648). Further, the POM has, a surface bending strength of 340 kg/cm$^2$ with respect to $10^7$ times of repeated loading. According to a series of tests conducted in the same manner as above, it is known that the POM will not be broken at all even during a continuous 500-hour test.

Further, if the resin for making the damper 13 contains an elastomer (a kind of adhesive and elastic material), the damper 13 thus formed will be more effective for prohibiting temperature rising and will have further improved impact resistance.

An elastomer used in the present invention, preferably has a high extendibility and a high flexibility, capable of returning back to its original shape (size) even after being extended to a size that is two times as large as its original size. In practice, such an elastomer may be a natural or a synthetic rubber.

For instance, the resin/elastomer mixture may contain 5% by weight of an urethane elastomer. The damper 13 may be made by injecting a predetermined amount of the resin/elastomer mixture into a metal mold. In this way, the elastomer will sufficiently melt so as to be fully mixed with the resin. As a result, each elastomer particle will become a stress gathering center, generating crazes near by (each including fibril and void), thereby absorbing energy released therefrom.

With the effect of the above constitution of the damper 13, it is possible to reduce a kind of internal friction within the resin material, thus inhibiting an undesirable heat generation. Further, elastomer particles contained in the resin material are capable of absorbing heat and increasing impact resistance.

In addition, in order to further improve the impact resistance of the damper 13, it is preferable to employ another mixing method for mixing a resin with an elastomer. In such a method, an elastomer is introduced into the resin by way of graft copolymerization, making resin component in continuous state but rendering the elastomer component in discrete state, thereby forming a structure like a multi-layer structure. With the use of such a mixing method, a combining force between resin and elastomer will be increased, thus improving the impact resistance of a damper.

Furthermore, if a resin for making a damper contains a reinforcing fiber such as a glass fiber, the damper thus formed will have a further improved strength and a further improved folding endurance. In such a case, a further improved strength of a damper may be obtained not only due to the reinforcing fiber itself, but also due to a fact that a crystallinity of a resin may be increased by mixing thereinto a different material. In fact, an increase in the strength of a damper will provide a higher thermal deformation temperature, thereby improving its heat resistance.

Since a glass fiber has a strong orientation, it will be arranged in a resin flowing direction in a metal mold. For this reason, a damper will be easily reinforced symmetrically with respect to the center axis thereof.

Figure 4A:
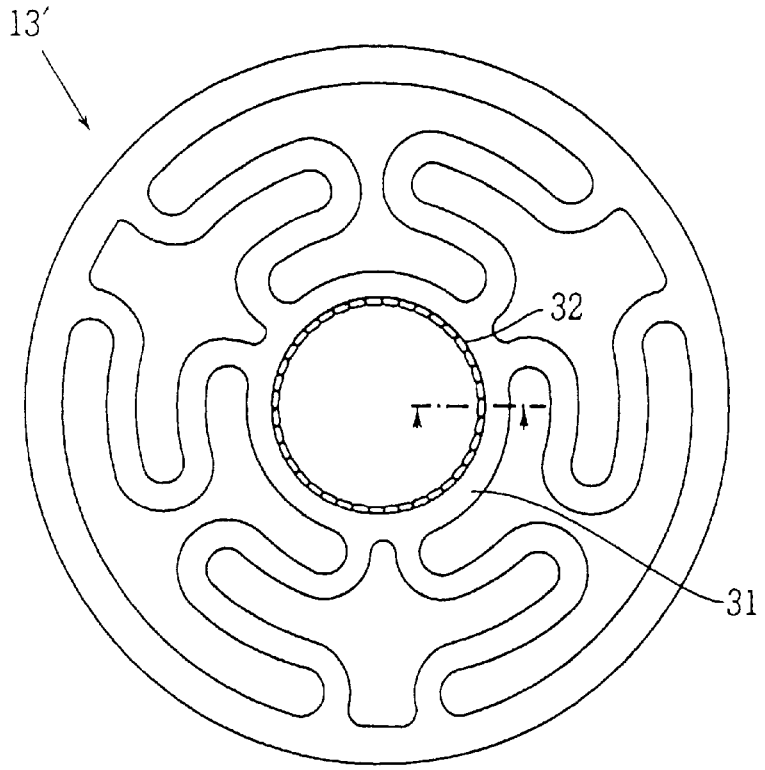
FIG. 4*a* is a plane view showing another damper for use in a speaker apparatus according to the present invention.
Figure 4B:
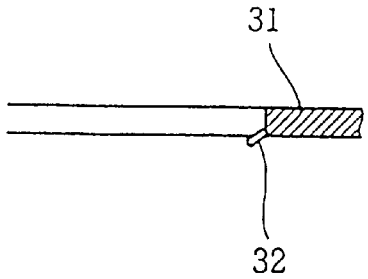
FIG. 4*b* is a cross sectional view taken along a line 4B—4B in FIG. 4*a*, partially showing the damper of FIG. 4*a*, in an enlarged scale.

FIG. 4*a* shows another embodiment of a damper according to the present invention. As shown in FIG. 4, a damper 13' has an annular hinge portion 32 provided around its inner circumferential portion 31 (also see FIG. 4*b*). When a voice coil wound around a bobbin is passed through the center hole of the damper 13', the annular hinge portion 32 will properly bend to effect an easy pass of the voice coil therethrough. Since the annular hinge portion 32 is made of a soft resilient material, the bobbin carrying the voice coil may be easily held by the annular hinge portion 32 so as to be fixed on a desired relative position with respect to the damper 13', without forming any gaps between the annular hinge portion 32 and the bobbin. Therefore, the bobbin may be easily bonded to the damper 13' on the inner circumferential wall thereof without any deviation.

Figure 5A:
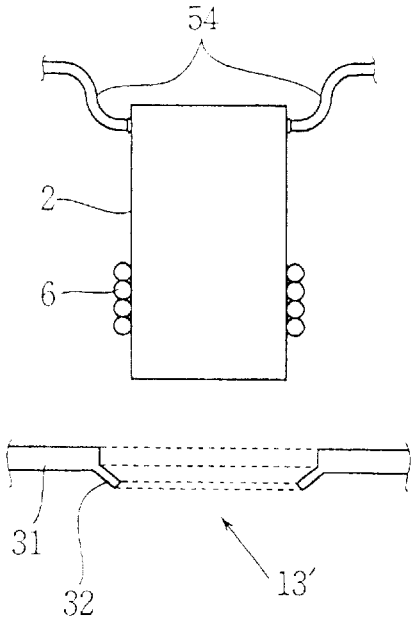
FIG. 5*a* is an explanatory view showing a condition in which a bobbin carrying a voice coil is to be attached to a damper of the present invention.
Figure 5B:
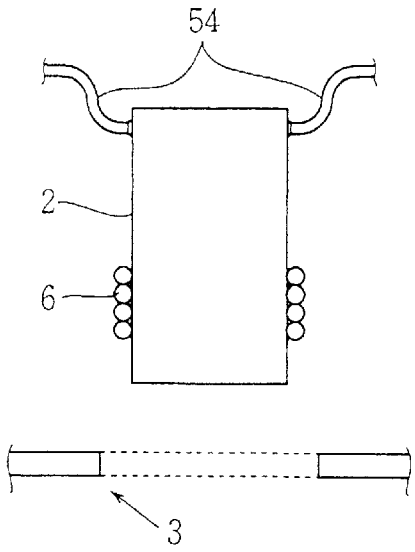
FIG. 5*b* is an explanatory view showing a condition in which a bobbin carrying a voice coil is to be attached to a damper of prior art.
Figure 6:
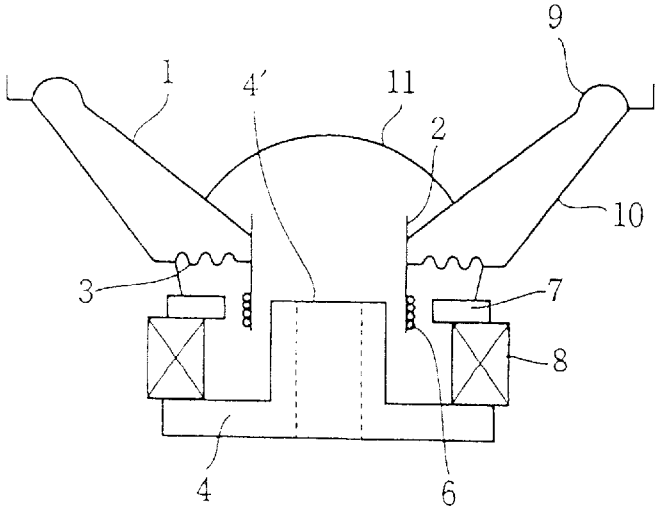
FIG.6 PRIOR ART
FIG. 6 is a cross sectional view showing a speaker apparatus according to prior art.

FIG. 5*a* shows a condition in which, a bobbin 2 carrying a voice coil 6 and a cotton-metal wire 54 is to be attached to a damper 13' of the present invention. As shown in FIG. 5*a*, the annular hinge portion 32 is formed on the inner circumferential portion 31 of the damper 13'. When the annular hinge portion 32 is to be bonded with the bobbin 2 at a position between the cotton-metal wire 54 and the voice coil 6, at first the voice coil 6 is caused to pass through the center hole of the damper 13'. This time, the annular hinge portion 32 will freely bend so as to effect a smooth pass of the voice coil 6 through the centre hole. After the voice coil 6 reaches a predetermined position, the annular hinge portion 32 restores to its original shape, so that any possible gap between the inner circumferential portion 31 and the bobbin 2 may be covered by the annular hinge portion 32. Therefore, under the condition shown in FIG. 5*a*, the bonding position between the damper 13' and the bobbin 2 may be easily maintained, thereby obtaining a better bonding effect than a prior art condition shown in FIG. 5*b* (in which an annular gap between the bobbin 2 and the inner circumferential portion of the damp 3 is larger than the thickness of the voice coil 6).

It is understood from the above description that, with the use of the present invention, it is possible to obtain at least the following effects.

(1) since a damper is formed by injecting a predetermined amount of resin into a metal mold through a plurality of inlets formed thereon, it can be expected to produce a speaker apparatus having a damper without an aeolotropy problem.

(2) Further, since the above resin material for making a damper contains, as a main component, a PBT (polybutylene terephthalate) or polyoxymethylene, it has been possible to produce a speaker apparatus having a damper with an improved durability.

(3) Moreover, since a resin material for making the damper contains a reinforcing fiber or an elastomer material, we can produce a speaker apparatus having a damper with a durability improved still further.

(4) In addition, since an annular hinge portion is formed on the inner circumferential portion of a damper, any possible gap between the inner circumferential portion of a damper and the bobbin may be covered by the annular hinge portion. Therefore, the bonding position between the damper and the bobbin may be easily maintained, ensuring a correct combination of the bobbin with the damper.

While the presently preferred embodiments of the this invention have been shown and described above, it is to be understood that these disclosures are for the purpose of illustration and that various changes and modifications may be made without departing from the scope of the invention as set forth in the appended claims.

What is claimed is:

1. A speaker apparatus having a damper for supporting vibrating elements including a vibrating diaphragm, said damper comprising:

an inner circumferential portion and an outer circumferential portion, both of which are connected with each other through several pairs of connecting portions with each pair having a butterfly shape;

wherein each connecting portion includes a bent portion such that the inner circumferential portion of the damper has a large movable area;

wherein each pair of connecting portions are arranged symmetrically with respect to each other for preventing a formation of a tensile force occurring on the damper in the circumferential direction thereof;

whereby said damper is formed by injecting a predetermined amount of a resin material into a metal mold of an injection molding equipment.

2. A speaker apparatus according to claim 1, wherein said damper is formed by injecting a predetermined amount of a resin material into the metal mold through a plurality of injection inlets formed thereon.

3. A speaker apparatus according to claim 2, wherein the plurality of injection inlets are symmetrically formed on the metal mold with respect to the center axis of the damper.

4. A speaker apparatus according to claim 3, wherein some of the injection inlets are formed on an inner circumferential portion of the metal mold, and other injection inlets are formed on an outer circumferential portion of the metal mold.

5. A speaker apparatus according to claim 1, wherein the resin material for making the damper contains a PBT (polybutylene terephthalate) as its main component.

6. A speaker apparatus according to claim 1, wherein the resin material for making the damper contains a polyoxymethylene as its main component.

7. A speaker apparatus according to claim 1, wherein the resin material for making the damper contains a reinforcing fiber as its additive.

8. A speaker apparatus according to claim 1, wherein the resin material for making the damper contains an elastomer as its additive.

9. A speaker apparatus according to claim 1, wherein the damper has the inner circumferential portion provided with an annular hinge portion.

10. A speaker apparatus according to claim 1, wherein the connecting portion contains a gap formed therein.

11. The speaker apparatus according to claim 1 wherein said bent portion is bent in a circumferential direction to said inner circumferential portion.

* * * * *